US005120373A

United States Patent [19]

Miller et al.

[11] Patent Number: 5,120,373

[45] Date of Patent: Jun. 9, 1992

[54] SUPERALLOY FORGING PROCESS

[75] Inventors: John A. Miller, Jupiter, Fla.; Daniel F. Paulonis, Higganum; Paul D. Genereux, Cromwell, both of Conn.; Jeffery W. Samuelson, Jupiter, Fla.; Laurence A. Jackman, Monroe, N.C.; Frederick P. Vaccaro, Waxhaw, N.C.; William M. Thomas, Monroe, N.C.

[73] Assignees: United Technologies Corporation, Hartford, Conn.; Teledyne Industries, Inc., Los Angeles, Calif.

[21] Appl. No.: 685,580

[22] Filed: Apr. 15, 1991

[51] Int. Cl.[5] ..... C22F 1/10

[52] U.S. Cl. ..... 148/564; 148/676; 148/707

[58] Field of Search ..... 148/2, 11.5 N, 12.7 N, 148/162, 410

[56] References Cited

U.S. PATENT DOCUMENTS

| | | | |
|---|---|---|---|
| 3,677,631 | 5/1954 | Gresham et al. | 148/12.7 N |
| 4,514,360 | 4/1985 | Giamei et al. | 148/11.5 N |
| 4,574,015 | 3/1986 | Genereux et al. | 148/12.7 N |
| 4,579,602 | 4/1986 | Paulonis et al. | 148/12.7 N |
| 4,612,062 | 9/1986 | Nazmy et al. | 148/11.5 N |
| 4,685,977 | 8/1987 | Chang | 148/12.7 N |
| 4,769,087 | 9/1988 | Genereux et al. | 148/12.7 N |
| 4,814,023 | 3/1989 | Chang | 148/12.7 N |
| 4,820,356 | 4/1989 | Blackburn et al. | 148/12.7 N |

*Primary Examiner*—H. Dean
*Assistant Examiner*—Margery S. Phipps

[57] ABSTRACT

A process for producing a fine grain forged superalloy article having a high yield strength at intermediate temperatures. A preferred starting composition comprises, by weight, 15% Cr, 13.6% Co, 4.1% Mo, 4.6% Ti, 2.2% Al, 0.01% C, 0.007% B, 0.07% Zr, balance Ni. This material is forged at a temperature above the gamma prime solvus and at a true strain of at least 0.5. Alternately, the material may be forged below the gamma prime solvus temperature with intermediate super solvus anneals. The overaged material is then worked at a temperature below the gamma prime solvus. The resultant fine grain material is then heat treated or can be further isothermally forged prior to heat treatment to produce complex shapes.

1 Claim, 5 Drawing Sheets

SUPERALLOY FORGING PROCESS

CROSS REFERENCE TO RELATED APPLICATIONS

This application relates to copending U.S. patent application Ser. No. 07/685,581, for SUPERALLOY FORGING PROCESS AND RELATED COMPOSITION by Roy L. Athey et al filed on even date herewith.

TECHNICAL FIELD

The present invention relates to a process for forging superalloys within a particular composition range. The resultant material is fine grained and has good intermediate temperature mechanical properties. The fine grain material may also be further processed by isothermal forging.

BACKGROUND OF THE INVENTION

Nickel base superalloys are widely used in gas turbine engines and have evolved greatly over the last 50 years. As used herein the term superalloy will mean a nickel base superalloy containing a substantial amount of the gamma prime ($Ni_3Al$) strengthening phase, preferably from about 30 to about 50 volume percent of the gamma prime phase.

Processing techniques for superalloys have also evolved and many of the newer processes are quite costly.

U.S. Pat. No. 3,519,503 describes an isothermal forging process for producing complex superalloy shapes. This process is currently widely used, and as currently practiced requires that the starting material be produced by powder metallurgy techniques. The reliance on powder metallurgy techniques makes this process expensive.

U.S. Pat. No. 4,574,015 deals with a method for improving the forgeability of superalloys by producing overaged microstructures in such alloys. The gamma prime phase particle size is greatly increased over that which would normally be observed.

U.S. Pat. No. 4,579,602 deals with a superalloy forging sequence which involves an overage heat treatment.

U.S Pat. No. 4,769,087 describes another forging sequence for superalloys which includes an overage step.

U.S. Pat. No. 4,612,062 describes a forging sequence for producing a fine grained article from a nickel base superalloy. The process includes a first deformation step at a temperature above the gamma prime solvus and a second deformation step at a temperature below the gamma prime solvus with specified strain rates and deformation amounts.

U.S. Pat. No. 4,453,985 describes an isothermal forging process which produces a fine grain product.

U.S. Pat. No. 2,977,222 describes a class of superalloys which are similar to those to which the invention process has particular applicability.

SUMMARY OF THE INVENTION

The present invention provides a process for producing a fine grained article and is especially appropriate for use with a specified range of alloy compositions. The resultant fine grained material may be used in its fine grained condition for articles which require high strength, particularly high yield strength at intermediate temperatures, or this fine grained material may be used as a forging preform for conversion by isothermal or hot die forging into complex shapes. Table I lists broad, intermediate and preferred composition ranges.

TABLE I

| | Compositional Ranges (by Weight Percent) | | |
|---|---|---|---|
| | Broad | Intermediate | Preferred |
| Cr | 12–20 | 12–20 | 13–18 |
| Co | 10–20 | 10–20 | 10–15 |
| Mo | 2–5.5 | 2–5.5 | 3–5 |
| Ti | 3–7 | 3.5–7 | 3.6–5.6 |
| Al | 1.2–3.5 | 1.2–3.5 | 1.7–2.7 |
| C | .005–.25(1) | .005–.15(1) | .01–.13(1) |
| B | .005–.05 | .005–.05 | .005–.05 |
| Zr | .01–.1 | .01–.1 | .01–.1 |
| Ta | 0–1 | — | — |
| W | 0–4.5 | 0–2.5 | — |
| Nb | 0–1 | — | — |
| Fe | 0–2.0 | 0–2.0 | 0–.5 |
| Hf | 0–.3 | — | — |
| Y | 0–.02 | — | — |
| V | 0–.1 | — | — |
| Re | 0–1.0 | — | — |
| Ni | Bal | Bal | Bal |

(1)an upper C limit of about .013% is preferred for applications where fatigue resistance is critical Related compositions are known in the art including those superalloy materials known as Waspaloy, Udimet 720, Astroloy and René 88 which are described in patents including U.S. Pat. Nos. 2,977,222, 4,083,734, and 4,957,567.

The preferred composition can be viewed as a derivative of the commercial alloy known as Waspaloy (nominal composition 19.5% Cr, 13.5% Co, 4.2% Mo, 3.0% Ti, 1.4% Al, .05% C, .007% B, .07% Zr, 0–2% Fe, balance Ni). Waspaloy is the most widely used superalloy and it is a significant economic advantage that the present invention preferred composition can be produced using a large quantity of Waspaloy scrap or revert material.

The major difference between Waspaloy and the preferred composition is that the preferred composition contains larger amounts of gamma prime formers (Al and Ti) and therefore contains about 1.3 times more gamma prime (about 40% by volume) than does Waspaloy. The increased gamma prime levels produce increased strength properties. The material also has an increased gamma prime solvus temperature, this permits the material to be processed below the gamma prime solvus, but at a high enough temperature so that the capacities of forging equipment is not exceeded. The preferred material possesses, to our knowledge, the best resistance to crack growth for this level of gamma prime and strength.

FIG. 1 is a block diagram which broadly sets out the invention process. As can be seen in FIG. 1, the process starts with a casting of the desired composition which preferably has a relatively fine grain size. After homogenization, the cast material may be processed according to two primary schemes or combinations thereof. According to one scheme, the left branch of the FIG. 1 diagram, the cast material is deformed at elevated temperatures but below the gamma prime solvus so that gamma prime phase dissolution is minimized or even eliminated. Subsolvus anneals or reheat treatments may be employed to maintain billet temperature, affect recrystallization, while avoiding or minimizing gamma prime phase dissolution. In addition, super-solvus anneals or reheat treatments may be employed to produce extensive or complete gamma prime phase dissolution in conjunction with extensive or complete recrystallization. The total amount of work required will be equivalent to that required to produce at least 0.5 and preferably at least 0.9 cumulative true strain. This cumulative true strain may be obtained from combined hot deformation operations including upsetting and drawing. During upsetting an average strain rate of at least about 0.1 in/in/min. is preferred. During drawing an average strain rate of at least about 0.5 in/in/min is preferred. To perform this amount of work on a cast superalloy material at a temperature below the gamma prime solvus, it will undoubtedly be necessary to use multiple deformation steps with intermediate anneals above the gamma prime solvus, to prevent cracking.

According to the right branch of FIG. 1, the material may alternately be hot worked at a temperature above the gamma prime solvus.

It is also, of course, possible to accomplish this initial hot working operation using a combination of steps above and below the gamma prime solvus in conjunction with appropriate combinations of intermediate hypersolvus or supersolvus treatments.

After the material has been deformed an amount in excess of 0.5 cumulative true strain, it is given an overage treatment to produce a significantly enlarged gamma prime particle size over that which would normally be present. The resultant microstructure is termed "overaged". The overaging process is similar to that described in U.S. Pat. No. 4,574,015 and consists of cooling the material at a rate of less than about 100° F. and preferably 50° F. per hour, (and most preferably less than 20° F. per hour) through the gamma prime solvus. The resultant coarsened gamma prime particle size will be in excess of 1 micron and preferably in excess of 2 microns.

This overaged material is then further hot deformed an amount in excess of that required to produce a cumulative true strain of 0.9, and preferably a true cumulative strain of 1.6. This strain does not include that undergone before the overage treatment. A strain rate of at least about 0.1 in/in/min is employed. This further deformation is accomplished below the gamma prime solvus (but within 200° F.) and without intermediate anneals. Intermediate reheats may be performed at temperatures below but within 200° F. of the gamma prime solvus temperature. The resultant material will have an exceptionally fine grain size, predominately finer than ASTM grain size 10 and usually on the order of ASTM 14 or finer. ASTM grain sizes are listed in Table II.

TABLE II

| ASTM | Avg. Grain Dia./mm |
|---|---|
| 2 | .18 |
| 4 | .091 |
| 6 | .044 |
| 8 | .022 |
| 10 | .011 |
| 12 | .006 |
| 14 | .003 |
| 16 | .0015 |
| 18 | .0007 |

Depending on the size and contour of the article, some larger unrecrystallized grains may remain at the very center of the article where the effective amount of deformation was insufficient to promote full recrystallization. Such unrecrystallized regions usually comprise less than 10% by volume of the material.

The combination of the invention process and the preferred composition reliability results in material with an ASTM 12-18 grain size, the finest grain size we have ever observed in production superalloys. The fine grain size contributes to increased strength, ductility and toughness at temperatures up to at least 1200° F. The fine grain size also provides a significant enhancement in ultrasonic nondestructive testing sensitivity. Small defects can be detected at increased depths relative to coarse grained material.

This exceptionally fine grained superalloy material is adapted to be used at temperatures up to about 1200° F.

Another advantage is that this material in ASTM 10 and finer grain size can be electron beam welded without difficulty. In contrast, conventional (coarse grain) Waspaloy is marginally E.B. weldable at best, even though it contains less gamma prime and is weaker.

This fine grained material is also suitable to be isothermally or hot die forged to produce complex articles according to the teachings of U.S. Pat. No. 3,519,503, incorporated herein by reference. The processing steps described heretofore in this application provide a material which is "conditioned" as described in U.S. Pat. No. 3,519,503 and which may be forged according to the teachings of that patent.

The foregoing, and other features and advantages of the present invention will become more apparent from the following description and accompanying drawings.

BEST MODE FOR CARRYING OUT THE INVENTION

One preferred form of the present invention will be described with reference to FIG. 2 which is a block diagram of a process particularly adapted to produce disk preforms and shafts for gas turbine engines.

Figure 1:
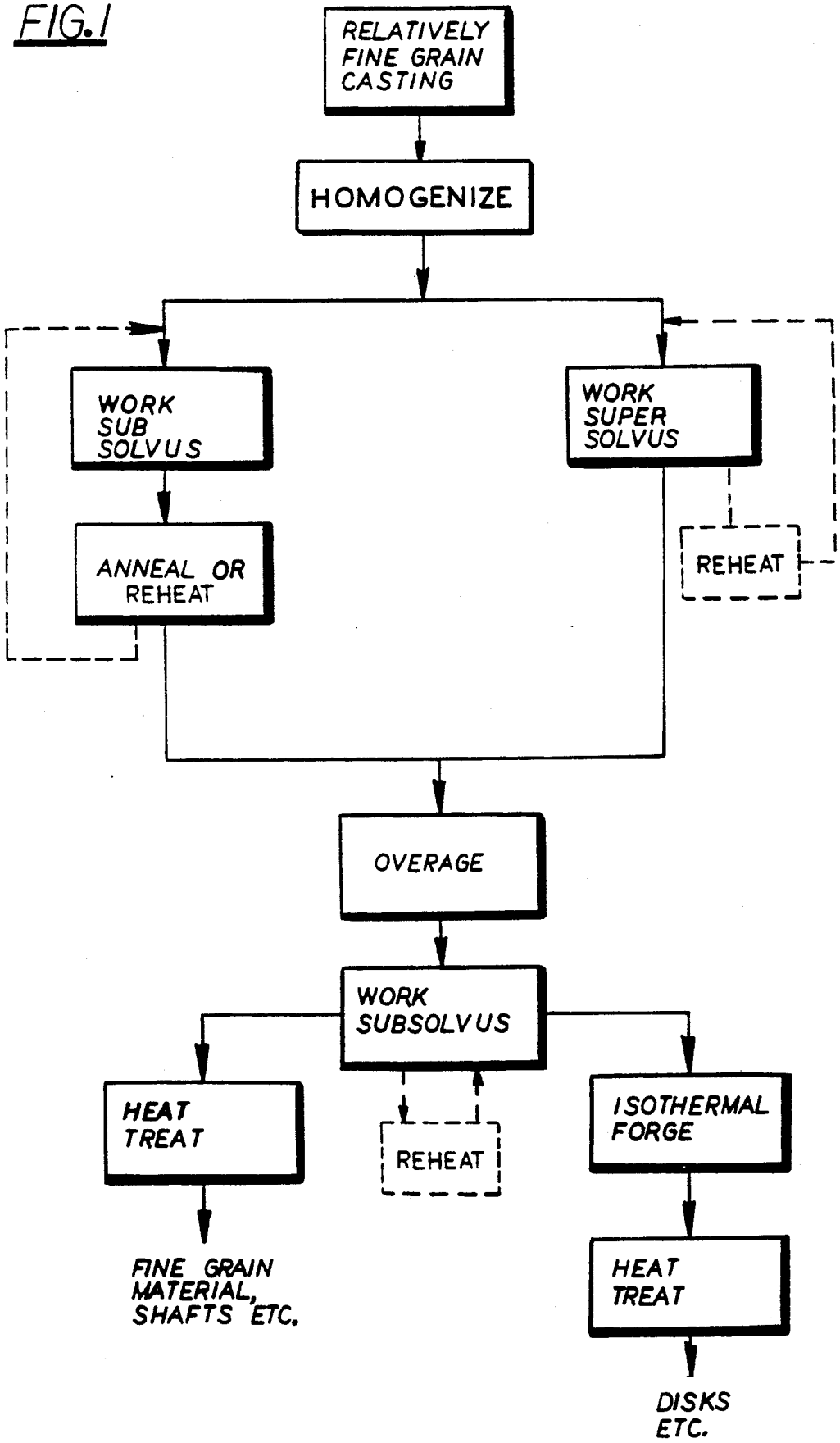
FIG. 1 is a block diagram showing the essential steps of the invention process.
Figure 2:
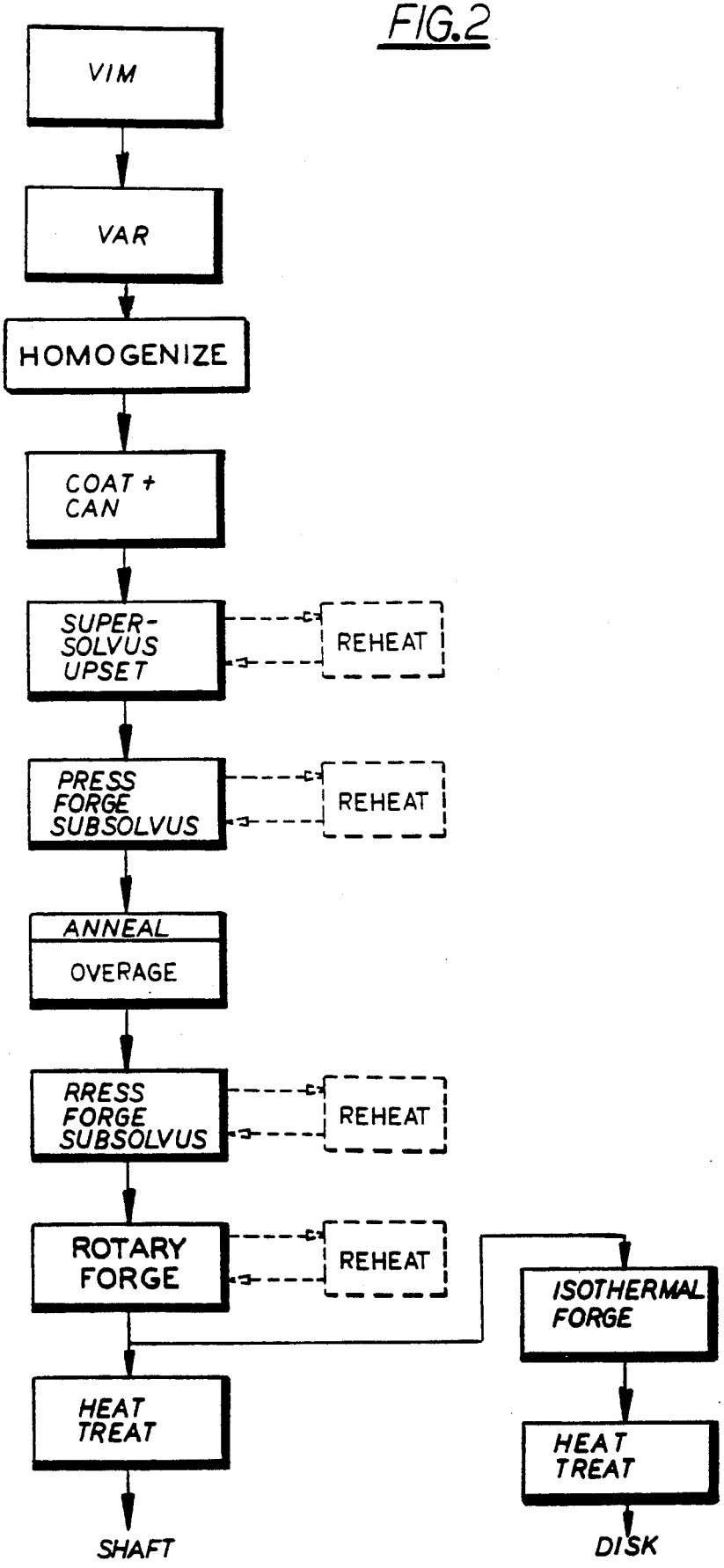
FIG. 2 is a block diagram showing the steps of a preferred embodiment of the invention.

According to the process shown in FIG. 2, material whose composition falls within the scope of Table I is first vacuum induction melted. In a particular actual example, vacuum induction material was produced as a 21 inch diameter cylinder. This material is then vacuum arc remelted to produce a cylindrical casting having a 24 inch diameter and a grain size on the order of 1/16 to = inch. In this respect it should be noted that the preferred compositions are essentially free from the heavier refractory metals such as tungsten and tantalum which can interfere with the production of fine grain sized unsegregated material.

In the preferred embodiment this 24 inch diameter vacuum arc remelted material was then coated with a glass ceramic coating (Ceramguard 11, a product of A.D. Smith Co. of Florence, Ky.). This coated casting was soaked at 2175° F. for 72 hours and was encased in a mild steel can having a ¼ inch thickness. The glass ceramic coating serves as a lubricant and prevents the steel can from interacting with the superalloy material. The steel can reduces cracking during initial hot deformation in part because it reduces chilling of the workpiece surface by the die. The order of the coating, homogenization and canning operations is not critical except that coating must precede canning, and if mild steel is used for the canning material, homogenization must precede canning because the canning material will not survive the homogenization conditions.

The casting was then upset, in the axial direction, between flat dies at a temperature of 2175° F. to reduce the length of the cylinder and increase the diameter of the cylinder from 24 inches to 32 inches in diameter at a strain rate of about 0.5 in/in/min. This results in a true strain of −0.58.

Since the gamma prime solvus for the material used was between 2030° F. and 2050° F., the soaking and upset operations were performed above the gamma prime solvus temperature. The 32 inch diameter material was then press forged radially between flat dies at a temperature of 2000° F. (below the gamma prime solvus temperature) to reduce the diameter from 32 inches to 24 inches at a rate of about 0.5 in/in/min. Note that the diameter at this point was the same as the starting diameter but the material had been subjected to a total cumulative true strain of about 1.16. The absolute values of strains are added since redundant strain is useful in achieving the necessary microstructure. The material was then heated to 2150° F., (above the gamma prime solvus temperature) and was soaked at this temperature for 4 hours. The hot forging was then immediately transferred to another furnace at a temperature of 1975° F. and held in that furnace for a period of six hours. During the time in the lower temperature furnace, the material (which started as a single phase material with no gamma prime phase), gradually passed through the gamma prime solvus temperature at a rate of about 20° F. per hour and gamma prime particles were precipitated. Because of the elevated temperature and long times involved, the precipitated gamma prime particles coarsened to a size predominantly in excess of 1 micron. The resultant structure was greatly overaged, meaning that the gamma prime particle size and spacing were much in excess of that which provides optimum mechanical properties. While two different temperature furnaces were used, it is apparent that a programmable furnace could also be utilized or that the furnace temperature could be manually reduced to produce the same result.

The 24 inch diameter overaged forging was then press forged, using flat dies, at a temperature of 1975° F. to a diameter of 16 inches, producing a true strain of 0.81 at a strain rate of about 0.5 in/in/min. The material was then reheated at a temperature of 1975° F. and rotary forged with intermediate 1975° F. reheats to a final diameter of 7 inches. Rotary forging was performed in a GFM machine, by a rotary forging or swaging machine which is the product of GFM Holdings of Steyr, Austria and is described in U.S. Pat. Nos. 4,430,881, 3,889,514, and 3,871,223. Pairs of diametrically opposed hammers strike the workpiece repeatedly, as the workpiece is rotated. Other deformation techniques could have been employed. The true strain which results from converting the ingot from 16 inches diameter to 7 inches in diameter is about 1.65 and the strain rate is at least 3 in/in/min. The 7 inch diameter billet had a grain size of about ASTM 12–14, except for the central 2–3 inches which showed about 10% larger unrecrystallized grains.

The resultant material, with a diameter of 7 inches was ideally suited (after further machining and heat treatment) for use as a hollow shaft in a high thrust gas turbine engine application. Such shafts are used to transmit power from the turbine section forward to the compressor section and are required to have a high torque transmission capability.

Figure 3:
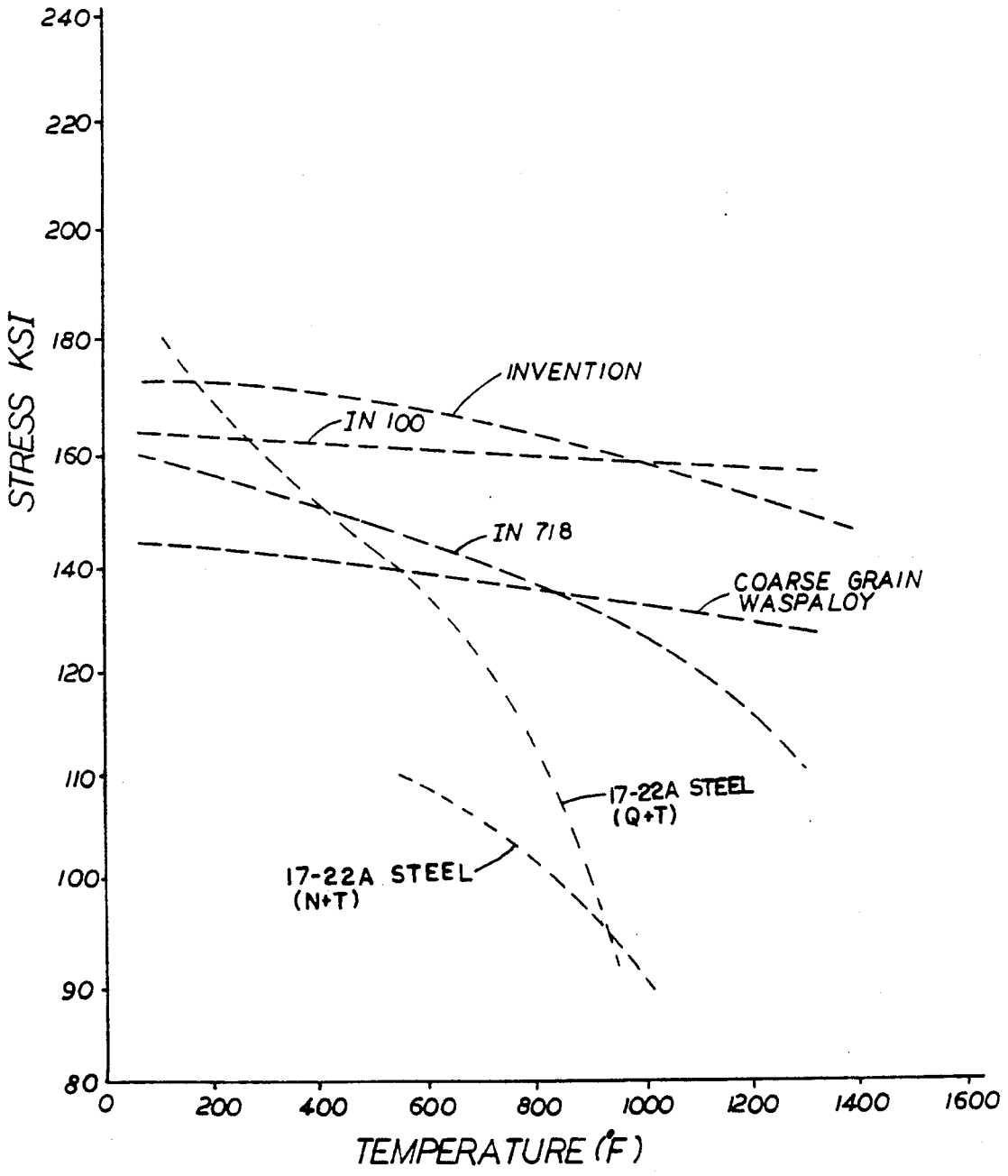
FIG. 3 is a plot of yield strength versus temperature for the invention material and several prior art materials.

The material property which is most associated with torque transmission capability in this type of application is yield strength. FIG. 3 shows yield strength as a function of temperature for several nickel base superalloys and for a high strength steel material (17-22A) which is conventionally used for gas turbine engine shafts.

It can be seen that the invention process material has the highest yield strength up to about 1000° F. of any of the materials tested. The material listed as IN 100 has a nominal composition of 12% Cr, 18% Co, 3.2% Mo, 4.3% Ti, 5.0% Al, .8% V, 0.07% C, 0.02% B, 0.06% Zr, balance Ni, and is one of the highest strength superalloys in common use. IN 100 has a gamma prime fraction of about 65% and is not reliably processable by the present invention, but instead must be processed using more costly powder metallurgical processing techniques. The material listed as Inconel 718 has a nominal composition of 19% Cr, 3.1% Mo, 5.3% (Cb+Ta), 0.9% Ti, 0.6% Al, 19% Fe, balance Ni, and a grain size of about ASTM 6, and it can be seen to have a yield strength which is 20 ksi less than that of the invention processed material with the debit in yield strength increasing with increasing temperature. The material labeled as coarse grained Waspaloy has a nominal composition of 19.5% Cr, 13.5% Co, 4.2% Mo, 3.0% Ti, 1.4% Al, 0.05% C, 0.006% B, 0.007% Zr, balance Ni, and grain size of approximately ASTM 4 and it has a yield strength which is approximately 30 ksi less than that of the invention processed material, with the debit in yield strength diminishing with increasing temperature. The material listed as steel has a nominal composition of 0.45% C, 0.55% Mn, 0.28% Si, 0.95% Cr, 0.55% Mo, 0.3% V, balance Fe, and was tested in the normalized and tempered (N+T) condition and the quenched and tempered (Q+T) condition. The normalized and tempered material can be seen to have a yield strength which is about 60–70 ksi less than that of the invention material, and to have a yield strength which drops sharply at temperatures above about 600° F. The quenched and tempered material strength drops sharply above about 400° F. Accordingly it can be seen that of these candidate materials, the present invention material displays a superior yield strength over a wide range of temperatures and is useful at temperatures up to at least about 1200° F.

Figure 4:
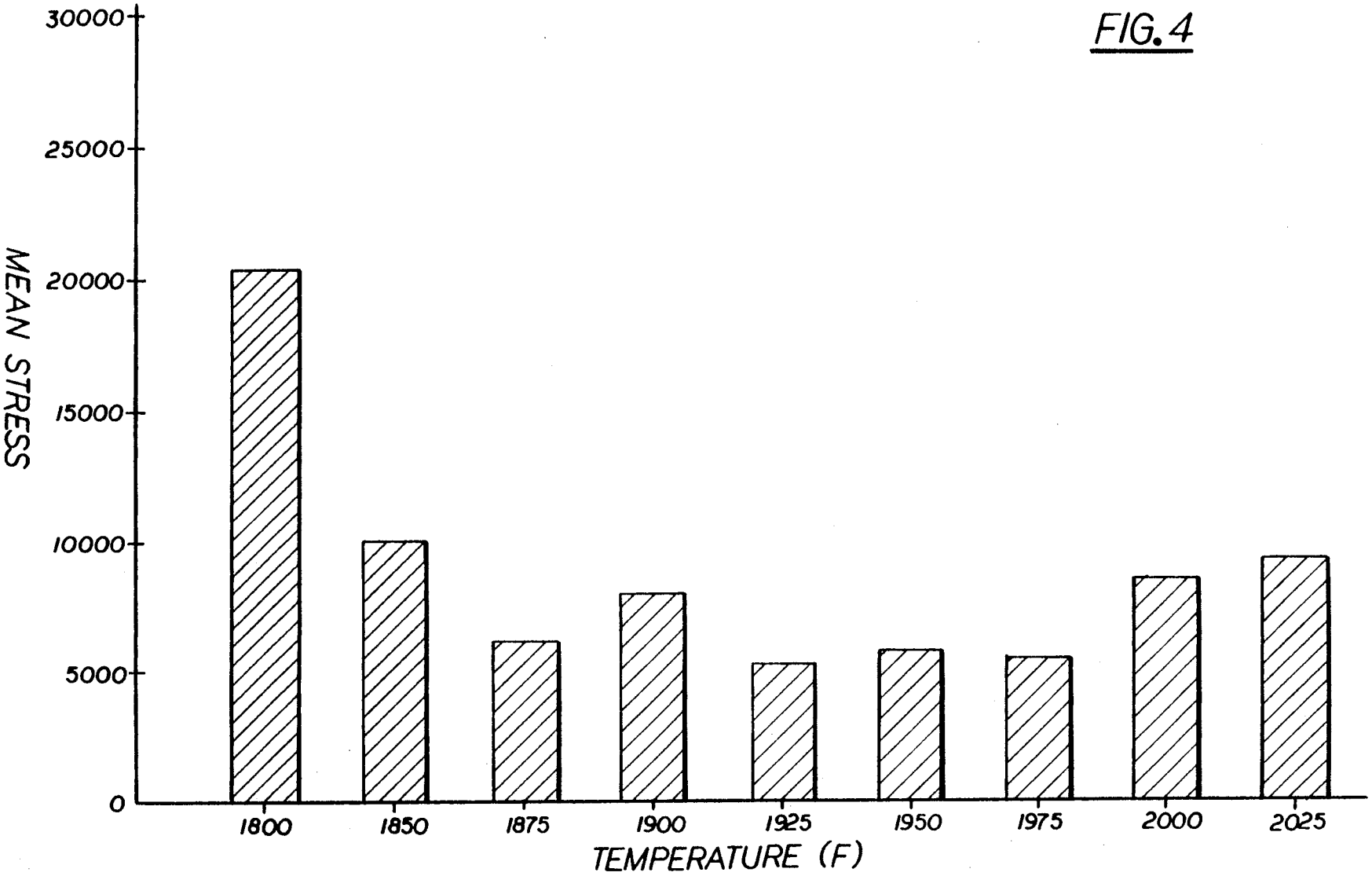
FIG. 4 is a bar graph of flow stress versus temperature for the invention material in the fine grain condition.
Figure 5:
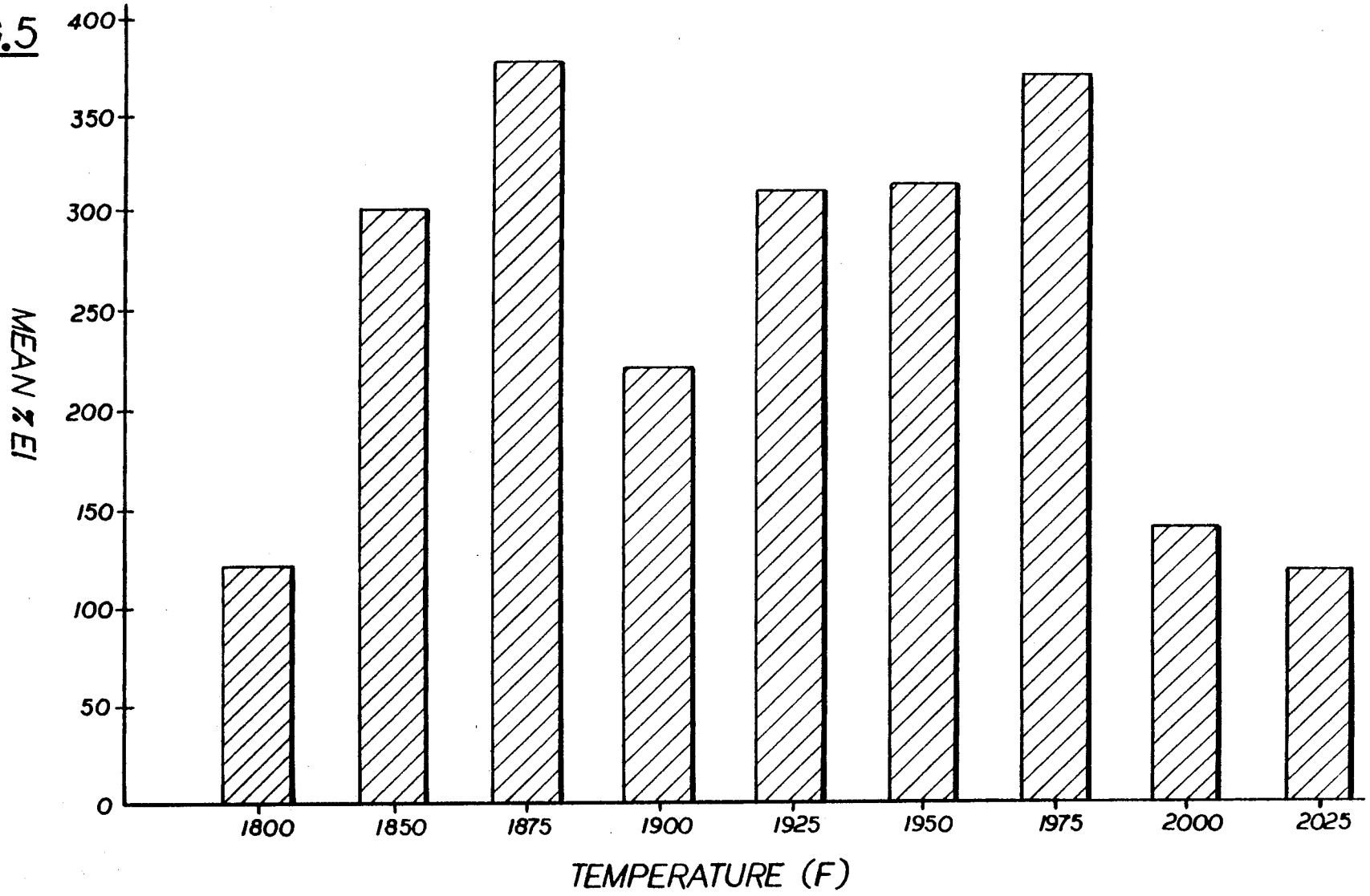
FIG. 5 is a bar graph of elongation versus temperature for the invention material in the fine grain condition.

The invention material in its fine grained form also displays useful super plastic properties over a fairly wide temperature range and can therefore be isothermally or hot die forged at relatively low forging stresses to form complex shapes. FIG. 4 shows the flow stress of this material when measured in a tensile test at a strain rate of 0.1 in/in/min. at several different temperatures, and it can be seen that for temperature between about 1850° F. and 2025° F., the invention processed material has a flow stress of less than about 10 ksi. FIG. 5 shows the tensile elongation results for the same material in tensile tests performed at 0.1 in/in/min., and it can be seen that at between 1850° F. and 1975° F. the invention material displayed more than about 150% tensile elongation. This indicates a capability of being formed into complex shapes without cracking.

In this context hot die forging means a process in which the forging dies are heated to within about 500° F. of the forging temperature and isothermal forging means that the dies are heated to within about 200° F. of the forging temperature.

The preferred composition has been selected to display the super plastic behavior needed for hot die or isothermal forging over a useful temperature range. Not all compositions in the broad range will display such behavior but the skilled artisan will readily be able to determine if a composition has the behavior by simple hot tensile tests.

Returning briefly to FIG. 2, the flow chart for the practical embodiment of the present invention, after the GFM forging operation the material is suitable for hot die or isothermal forging at a strain rate on the order of about 0.05–0.2 in/in/min. to form complex shapes such as gas turbine engine disks.

Although this invention has been shown and described with respect to detailed embodiments thereof, it will be understood by those skilled in the art that various changes in form and detail thereof may be made without departing from the spirit and scope of the claimed invention.

We claim:

1. Process for producing a superalloy article having a fine grain size and good mechanical properties at temperatures below about 1200° F., starting with a material consisting essentially, by weight, of 12–20% Cr, 10–20%Co, 2–5.5% Mo, 3–7% Ti, 1.2–3.5% Al, 0.005–0.25% C, 0.005–0.05% B, 0.01–0.1% Zr, 0–1% Ta, 0–4.5% W, 0–1% Nb, 0–2.0% Fe, 0–0.3% Hf, 0—0.02% Y, 0–1% V, 0–1.0% Re, balance Ni, and having a gamma prime solvus temperature, in the form of a casting, including the steps of:

a homogenizing said casting at a temperature above the gamma prime solvus temperature for a period of time from about 10 to about 100 hours;

b working said homogenized casting at a temperature above the gamma prime solvus to produce an intermediate forging;

c working said forging at a temperature below the gamma prime solvus with the sum of true strain produced by step b and this step c amounting to at least about 0.9 true strain;

d heating said forging to a temperature above the gamma prime solvus to dissolve the gamma prime phase and allow recrystallization and cooling said forging slowly through the gamma prime solvus temperature at a rate of less than about 100° F. per hour, to produce an over aged microstructure;

e further working said over aged forging at a temperature below but within 200° F. of the gamma prime solvus;

f rotary forging said material at a temperature below the gamma prime solvus with the sum of true strain produced by said working in steps e and f being equal to at least about 0.9 true strain; and g heat treating said material at a temperature below the gamma prime solvus whereby the resultant heat treated material has a grain size of finer than about ASTM 12.

* * * * *